US010968396B1

(12) United States Patent
Koseoglu et al.

(10) Patent No.: US 10,968,396 B1
(45) Date of Patent: Apr. 6, 2021

(54) METHOD AND PROCESS FOR PRODUCING NEEDLE COKE FROM AROMATIC POLYMER MATERIAL AND AROMATIC BOTTOMS OF AN AROMATIC RECOVERY COMPLEX

(71) Applicant: SAUDI ARABIAN OIL COMPANY, Dhahran (SA)

(72) Inventors: Omer Refa Koseoglu, Dhahran (SA); Robert Peter Hodgkins, Dhahran (SA); Tulay Inan, Dhahran (SA)

(73) Assignee: SAUDI ARABIAN OIL COMPANY

( * ) Notice: Subject to any disclaimer, the term of this patent is extended or adjusted under 35 U.S.C. 154(b) by 0 days.

(21) Appl. No.: 16/776,006

(22) Filed: Jan. 29, 2020

(51) Int. Cl.
*C10B 57/04* (2006.01)
*C10B 57/00* (2006.01)
*C10B 55/10* (2006.01)

(52) U.S. Cl.
CPC ..... *C10B 57/045* (2013.01); *C10B 55/10* (2013.01); *C10B 57/005* (2013.01)

(58) Field of Classification Search
CPC ..... C10B 55/10; C10B 57/005; C10B 57/045
See application file for complete search history.

(56) References Cited

U.S. PATENT DOCUMENTS 3,326,796 A 6/1967 Muller et al.
3,617,514 A 11/1971 Marlar
4,429,172 A 1/1984 Zellerhoff et al.
5,393,408 A * 2/1995 Ziemer ..... C10G 65/04 208/49
7,008,573 B2 3/2006 Ikeda et al.
8,343,334 B2 1/2013 Koseoglu
9,428,695 B2 8/2016 Narayanaswamy et al.
9,708,561 B2 * 7/2017 Scherer ..... C10M 129/72
10,053,401 B1 8/2018 Beadle et al.
10,093,873 B2 10/2018 Koseoglu et al.
10,294,172 B2 5/2019 Beadle et al.
10,508,066 B2 12/2019 Koseoglu et al.

FOREIGN PATENT DOCUMENTS

CN 101230284 A 7/2008
WO 1995014069 5/1995

OTHER PUBLICATIONS

Cheng, et al., "Needle coke formation derived from co-carbonization of ethylene tar pitch and polystyrene," Fuel, vol. 88, issue 11, Nov. 2009, pp. 2188-2192.

* cited by examiner

*Primary Examiner* — Brian A McCaig
(74) *Attorney, Agent, or Firm* — Bracewell LLP; Constance Gall Rhebergen

(57) ABSTRACT

Methods and systems for converting an aromatic polymer material and aromatic bottoms to needle-grade coke. An embodiment of a method includes supplying aromatic bottoms from an aromatic recovery complex; mixing the aromatic polymer material with the aromatic bottoms to obtain an aromatic polymer mixture comprising the aromatic polymer material and the aromatic bottoms; delayed coking the aromatic polymer mixture to obtain petroleum green coke and volatile components; fractionating the volatile components to obtain distillate products; and calcining the petroleum green coke to obtain needle coke.

24 Claims, 5 Drawing Sheets

METHOD AND PROCESS FOR PRODUCING NEEDLE COKE FROM AROMATIC POLYMER MATERIAL AND AROMATIC BOTTOMS OF AN AROMATIC RECOVERY COMPLEX

BACKGROUND OF THE INVENTION

1. Technical Field

The disclosure relates to processes and systems for producing needle coke. More specifically, processes and systems for producing needle coke by delayed coking a mixture of aromatic polymer dissolved in aromatic bottoms from an aromatic recovery complex.

2. Discussion of Related Art

Delayed coking is useful for converting vacuum residues derived from fossil fuels into various grades of coke. Needle-grade coke is a particularly valuable coke product that is useful in various commercial applications, particularly the production of electrodes. Typical feedstocks for delayed coking processes (such as vacuum residues) are not suitable for producing needle-grade coke because they are generally rich in nitrogen and can contain metals such as nickel and vanadium in significant concentrations. Conventional processes for producing needle coke include delayed coking fluid catalytic cracking decant oil or coal tar pitch.

SUMMARY OF THE INVENTION

Disclosed are methods and systems for producing needle-grade coke from aromatic polymer dissolved in aromatic bottoms from an aromatic recovery complex. A method for converting an aromatic polymer material and an aromatic bottoms to needle-grade coke is disclosed. The method includes supplying the aromatic bottoms from an aromatic recovery complex; mixing the aromatic polymer material with the aromatic bottoms to obtain an aromatic polymer mixture having the aromatic polymer material and the aromatic bottoms; delayed coking the aromatic polymer mixture to obtain petroleum green coke and volatile components; fractionating the volatile components to obtain distillate products; and calcining the petroleum green coke to obtain needle coke.

In at least one embodiment, the aromatic polymer material can be polystyrene. The aromatic bottoms can be free of sulfur, nitrogen, or both. In at least one embodiment, the aromatic bottoms can include C9+ hydrocarbons in the absence of C8− hydrocarbons. In at least one embodiment, the aromatic bottoms can include C10+ hydrocarbons in the absence of C9− hydrocarbons. In at least one embodiment, the aromatic bottoms can include C11+ hydrocarbons in the absence of C10−hydrocarbons. The aromatic bottoms can include a compound selected from the group consisting of alkyl-bridged noncondensed multiaromatic compounds, condensed multiaromatic compounds, heavy monoaromatic compounds, and combinations of the same. The aromatic bottoms can have a boiling point of at least 100° C. The aromatic bottoms can include up to 20 wt % aromatic polymer material. In at least one embodiment, the aromatic polymer material can include a waste plastic.

In at least one embodiment, the step of delayed coking the aromatic polymer mixture can include delayed coking the aromatic polymer mixture with a homogenous catalyst. The homogenous catalyst can include an element selected from the group consisting of IUPAC groups 4-7, and combinations of the same. In at least one embodiment, the homogenous catalyst can be selected from the group consisting of molybdenum acetylacetonate, molybdenum hexacarbonyl, and combinations of the same.

A method for converting an aromatic polymer material and an aromatic bottoms to needle-grade coke is disclosed. The method includes supplying the aromatic bottoms from an aromatic recovery complex, and hydrodearylating the aromatic bottoms to obtain hydrodearylated aromatic bottoms, mixing the aromatic polymer material with the hydrodearylated aromatic bottoms to obtain an aromatic polymer mixture having the aromatic polymer material and the hydrodearylated aromatic bottoms; delayed coking the aromatic polymer mixture to obtain petroleum green coke and volatile components; fractionating the volatile components to obtain distillate products and calcining the petroleum green coke to obtain needle coke.

In at least one embodiment, the aromatic polymer material includes polystyrene. The aromatic bottoms can be free of sulfur, nitrogen, or both. In at least one embodiment, the aromatic bottoms includes C9+ hydrocarbons in the absence of C8− hydrocarbons. In at least one embodiment, the aromatic bottoms includes C10+ hydrocarbons in the absence of C9− hydrocarbons. In at least one embodiment, the aromatic bottoms includes C11+ hydrocarbons in the absence of C10− hydrocarbons. The aromatic bottoms can include a compound selected from the group consisting of alkyl-bridged noncondensed multiaromatic compounds, condensed multiaromatic compounds, heavy monoaromatic compounds, and combinations of the same. The aromatic bottoms can have a boiling point of at least 100° C. The aromatic polymer mixture can have up to 20 wt % aromatic polymer material. In at least one embodiment, the aromatic polymer can include a waste plastic.

In at least one embodiment, the step of delayed coking the aromatic polymer mixture includes delayed coking the aromatic polymer mixture with a homogenous catalyst. The homogenous catalyst can include an element selected from the group consisting of IUPAC groups 4-7, and combinations of the same. In at least one embodiment, the homogenous catalyst can be selected from the group consisting of molybdenum acetylacetonate, molybdenum hexacarbonyl, and combinations of the same.

BRIEF DESCRIPTION OF THE DRAWINGS

The embodiments disclosed will be understood by the following detailed description along with the accompanying drawings. The embodiments shown in the figures only illustrate several embodiments of the disclosure. The disclosure admits of other embodiments not shown in the figures, and is not limited to the content of the illustrations. Similar streams, units, or features may have similar reference labels in the drawings.

DETAILED DESCRIPTION OF THE DRAWINGS

Figure 1:
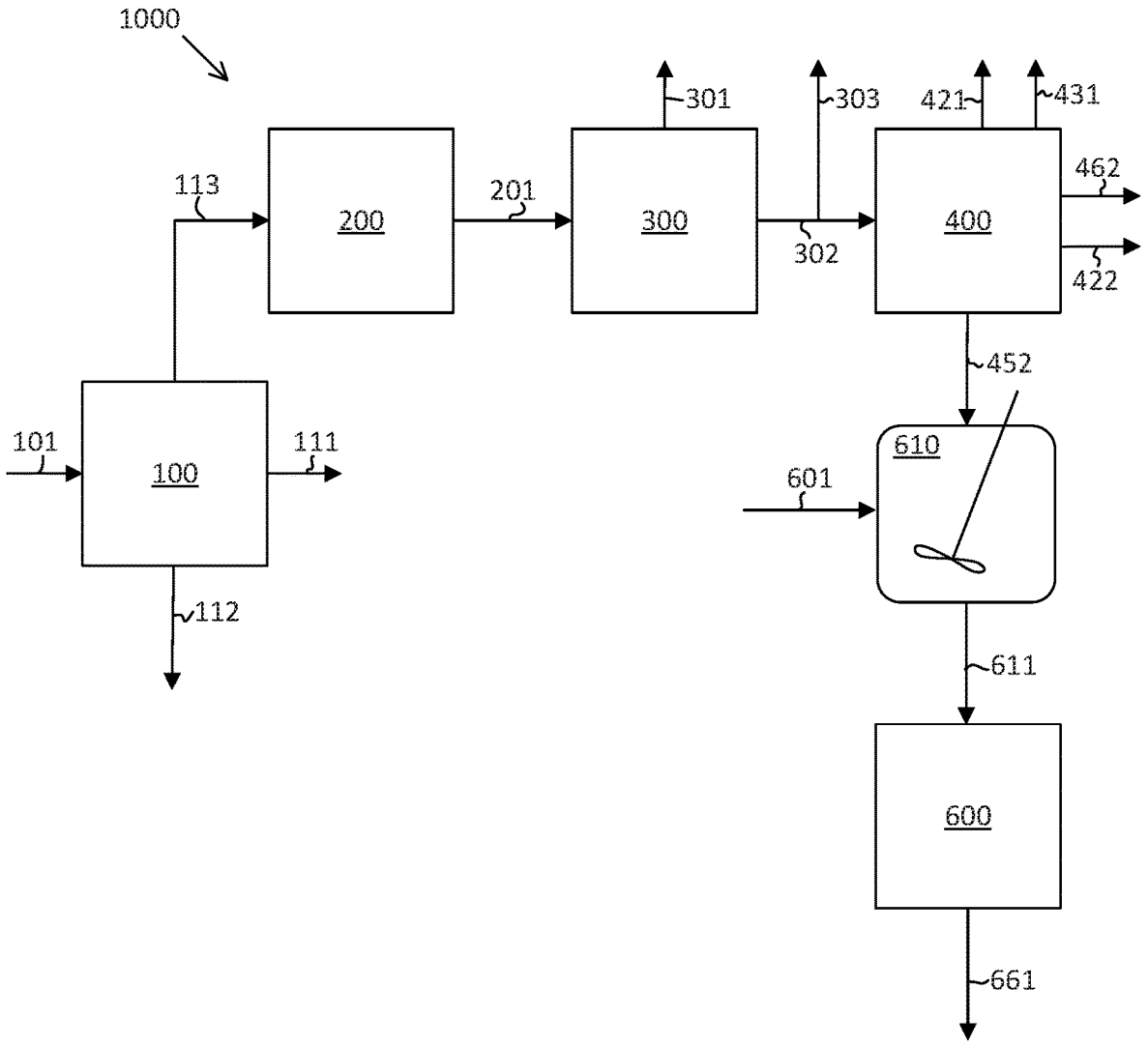
FIG. 1 is a schematic diagram of a process for producing needle-grade coke from an aromatic polymer mixture according to various embodiments.

For certain embodiments, many details are provided for thorough understanding of the various components or steps. In other instances, known processes, devices, compositions, and systems are not described in particular detail so that the embodiments are not obscured by detail. Likewise, illustrations of the various embodiments can omit certain features or details so that the various embodiments are not obscured.

The drawings provide an illustration of certain embodiments. Other embodiments can be used, and logical changes can be made without departing from the scope of this disclosure. The following detailed description and the embodiments it describes should not be taken in a limiting sense. This disclosure is intended to disclose certain embodiments with the understanding that many other undisclosed changes and modifications can fall within the spirit and scope of the disclosure. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal language of the claims.

The description can use the phrases "in some embodiments," "in various embodiments," "in an embodiment," "in at least one embodiment," or "in embodiments," which can each refer to one or more of the same or different embodiments. Furthermore, the terms "comprising," "including," "having," and the like, as used with respect to embodiments of the present disclosure are synonymous.

In this disclosure and the appended claims, unless otherwise indicated, all numbers expressing quantities, percentages or proportions, and other numerical values used in the specification and claims are to be understood as being modified in all instances by the term "about." The term "about" applies to all numeric values, whether or not explicitly indicated. Values modified by the term "about" can include a deviation of at least ±5% of the given value unless the deviation changes the nature or effect of the value such that it is not operable to achieve its intended purpose.

Ranges can be expressed in this disclosure as from about one particular value and to about another particular value. With these ranges, another embodiment is from the one particular value to the other particular value, along with all combinations within the range. When the range of values is described or referenced in this disclosure, the interval encompasses each intervening value between the upper limit and the lower limit, as well as the upper limit and the lower limit; and includes lesser ranges of the interval subject to any specific exclusion provided.

Unless otherwise defined, all technical and scientific terms used in this specification and the appended claims have the same meanings as commonly understood by one of ordinary skill in the relevant art.

Ordinal numbers (such as "first," "second," "third," and so on), when used in this disclosure as an adjectives before a term, merely identify a particular component, feature, step, or combination of these unless expressly provided otherwise. At times, ordinal numbers may be used to distinguish a particular feature, component, or step from another feature, component, or step that is described by the same term or similar term. Unless expressly provided otherwise, ordinal numbers do not indicate any relationship, order, quality, ranking, importance, or characteristic between features, components, steps, or combinations of these. Moreover, ordinal numbers do not define a numerical limit to the features, components, steps, or combination they identify.

Where a method comprising two or more defined steps is recited or referenced in this disclosure, or the appended claims, the defined steps can be carried out in any order or simultaneously except where the context excludes that possibility.

In the figures, fluid streams can be represented by lines. A person of ordinary skill will understand that fluid streams can be conveyed by various means, including but not limited to pipes, conduit, channels, and their attachments and fittings. Moreover, fluid streams are not limited to liquids, but may include solids. Though other equipment, such as pumps, valves, heat exchangers, storage tanks, reboilers, steam generators, reflux drums, reflux streams, condensers, controllers, and so forth, may be present in various embodiments, such equipment is not shown in the figures for the sake of clarity.

As used in this disclosure, the term "aromatic polymer" refers to a polymer or copolymer (including biopolymers, terpolymers, quaterpolymers, etc.) having an aromatic monomer (i.e., a monomer having at least one benzene ring).

As used in this disclosure, the term "waste polymer" refers to any plastic material having an aromatic polymer that has been collected for disposal or recycling. By way of example and not limitation, an example of a suitable waste polymer is recycled polystyrene.

As used in this disclosure, the term "particle size" refers to the distance in a straight line between the two most distant points on the outer surface of the particle. For example, a spherical particle has a particle size equal to its diameter and a rectangular prism-shaped particle has a particle size that is equal to the diagonal line or hypotenuse extending between the two most distant corners.

As used in this disclosure, the term "hydrodearylation" refers to a process for the cleaving of the alkyl bridge of non-condensed alkyl-bridged multi-aromatics or heavy alkyl aromatic compounds to form alkyl mono-aromatics, in the presence a catalyst and hydrogen.

The disclosed methods and processes provide alternatives to conventional waste polymer disposal methods that result in the production of useful and valuable aromatic products and needle coke. In addition to providing alternative methods for disposing of waste polymers, the methods and processes disclosed make economical use of low-value hydrocarbon streams. It has been found that aromatic bottoms from an aromatic recovery complex can dissolve aromatic polymer material for delayed coking processes. Advantageously, polystyrene dissolved with aromatic bottoms can have a lower concentration of contaminants such as sulfur and nitrogen than conventional coking feeds, and can be useful for the production of needle coke and aromatic products.

In FIG. 1, crude oil 101 is distilled in atmospheric distillation unit 100 to obtain naphtha (which boils in the range of about 36-180° C.) and diesel (which boils in the range of about 180-370° C.). An atmospheric residue fraction in atmospheric residue stream 112 boils at about 370° C. and greater. Naphtha stream 113 is hydrotreated in naphtha hydrotreating unit 200 to reduce sulfur and nitrogen content to less than about 0.5 ppmw, and the hydrotreated naphtha stream 201 is sent to naphtha reforming unit 300 to improve its quality, or in other words increase the octane number to obtain a gasoline blending stream or feedstock for an aromatics recovery unit. Diesel stream 111 is hydrotreated in a diesel hydrotreating unit (not shown) to desulfurize the diesel oil and obtain a diesel fraction complying with diesel fuel specifications (such as less than 10 ppmw sulfur). An atmospheric residue fraction is either used as a fuel oil component or sent to other separation or conversion units to convert low-value hydrocarbons to high-value products. Reformate stream 302 from naphtha reforming unit 300 can be used as a gasoline blending component (stream 303) or sent to an aromatic recovery complex 400 to recover aromatics such as benzene, toluene, and xylenes (collectively "BTX").

Figure 3:
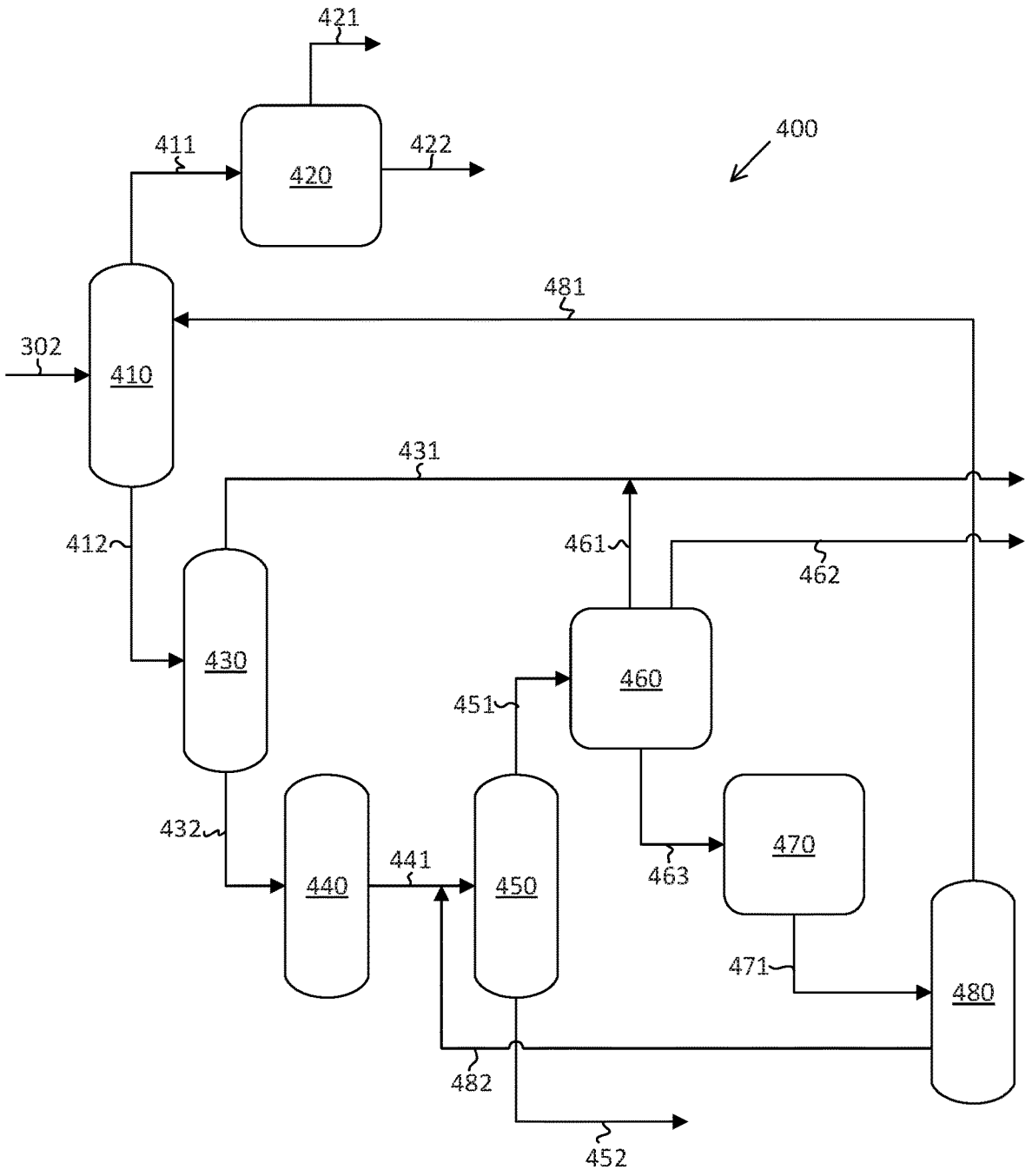
FIG. 3 is a schematic illustration of an aromatic recovery complex and process for obtaining benzene, toluene, and p-xylene that also produces aromatic bottoms.

Referring now to FIG. 3, a schematic illustration of an aromatic recovery complex 400 is shown. Reformate stream 302 from a catalytic reforming unit, such as naphtha reforming unit 300 of FIG. 1, is split into two fractions; light reformate stream 411 having C5 and C6 hydrocarbons, and heavy reformate stream 412 having C7+ hydrocarbons. A reformate splitter 410 separates reformate stream 302 to obtain a light reformate stream 411 and a heavy reformate stream 412. The light reformate stream 411 is sent to a benzene extraction unit 420 to extract benzene as benzene product in benzene stream 422, and to recover substantially benzene-free gasoline in raffinate motor gasoline (mogas) stream 421. The heavy reformate stream 412 is sent to a splitter 430 which produces a C7 cut mogas stream 431 and a C8+ hydrocarbon stream 432.

Most aromatic recovery complexes are configured to maximize p-xylene production. The C8+ hydrocarbon stream 432 is sent to a clay treater 440 and the C8+ product stream 441 is fed to a xylene rerun unit 450 to separate the C8+ hydrocarbons into C8 hydrocarbon stream 451 and aromatic bottoms stream 452 having C9+ hydrocarbons. The C8 hydrocarbon stream 451 proceeds to a p-xylene extraction unit 460 to recover p-xylene in p-xylene product stream 462. p-Xylene extraction unit 460 also produces a C7 cut mogas stream 461, which combines with C7 cut mogas stream 431. Other xylenes are recovered and sent to xylene isomerization unit 470 by other xylene stream 463 to convert them to p-xylene. The isomerized xylenes are sent to xylene splitter column 480. The converted fraction is recycled back to p-xylene extraction unit 460 from xylene splitter column 480 by way of xylene splitter bottom stream 482, xylene rerun unit 450, and C8 hydrocarbon stream 451. Splitter top stream 481 is recycled back to reformate splitter 410. The heavy fraction from the xylene rerun unit 450 is recovered as aromatic bottoms in aromatic bottoms stream 452. The heavy fraction from xylene rerun unit 450 can include C9+ components in the absence of C8− components. In at least one embodiment, the heavy fraction from xylene rerun unit 450 can be fractionated to obtain C9, C10, and C11+ components. The C9, and C10components are then sent to a toluene, C9, C10 transalkylation/toluene disproportionation unit (TA/TDP) and the C11+ components are removed in aromatic bottoms stream 452; in such embodiments, the aromatic bottoms can include C11+ components in the absence of C10− components.

The aromatic bottoms from aromatic bottoms stream 452 can include C9+ aromatic hydrocarbons in the absence of C8− hydrocarbons. In at least one embodiment, the aromatic bottoms from aromatic bottoms stream 452 can include C10+ hydrocarbons in the absence of C9− hydrocarbons. In at least one embodiment, the aromatic bottoms from aromatic bottoms stream 452 can include C11+ hydrocarbons in the absence of C10− hydrocarbons. The aromatic bottoms can include alkyl-bridged noncondensed multiaromatic compounds, condensed multiaromatic compounds, heavy monoaromatic compounds (i.e., at least one alkyl group with more than seven carbon atoms), and combinations of the same. Not intending to be limited by any particular technical theory, it is believed that alkenyl aromatics react across Lewis acid sites in the clay tower via a Friedel-Crafts reaction to form multiaromatic compounds with alkyl bridges that connect aromatic rings. This reaction typically occurs at temperatures of about 200° C. or greater. Alkenyl aromatics can react with these compounds to form multiaromatic compounds having additional aromatic rings connected by alkyl bridges. Such noncondensed multiaromatic compounds having two or more aromatic rings connected by alkyl bridges can be characterized as having a relatively high density (i.e., above about 900 kilograms per cubic meter ($kg/m^3$)), a darker brown color (Standard Reference Method Color greater than 20) than nonbridged alkyl aromatics, and a boiling point above about 250° C. Still not intending to be limited by any particular technical theory, it is also believed that nonaromatic olefins react across Lewis acid sites in the clay tower with monoaromatic molecules via a Friedel-Crafts reaction to form heavy monoaromatic compounds having at least one alkyl group with more than seven carbon atoms. This reaction typically also occurs at temperatures of about 200° C. or greater. These heavy monoaromatic compounds can be characterized as having density that is above about 800 $kg/m^3$ and a boiling point of about 250° C. or greater. The heavy monoaromatic compounds and alkyl-bridged noncondensed multiaromatic compounds produced by these reactions ultimately leave the aromatic recovery complex in aromatic bottoms stream 452. In at least one embodiment, the aromatic bottoms can have a boiling point above about 100° C., preferably above about 150° C., more preferably above about 180° C.

By way of example and not limitation, Formula I, Formula II, and Formula III show various examples of alkyl-bridged noncondensed multiaromatic compounds.

[Formula I]

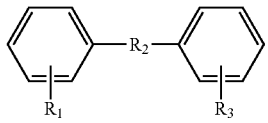

[Formula II]

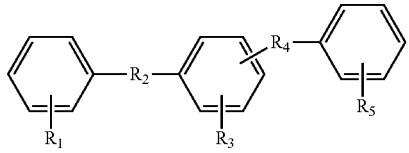

[Formula III]

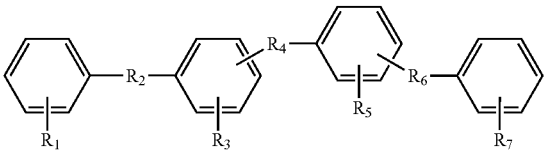

$R_2$, $R_4$, and $R_6$ are alkyl bridge groups independently having from two to six carbon atoms. $R_1$, R3, R5, and $R_7$ are independently selected from the group consisting of hydrogen and an alkyl group having from one to eight carbon atoms. In Formula I, $R_{1-3}$ are selected such that the total number of carbon atoms in the molecule is at least sixteen. In addition to the groups $R_1$, $R_3$, $R_5$, and R7, the benzene groups of Formulas I, II, and III can further include additional alkyl groups connected to the benzene groups. In addition to the four benzene groups of Formula III, the various alkyl-bridged noncondensed alkyl aromatic compounds can include five or more benzene groups connected by alkyl bridges, where the additional benzene groups further can include alkyl groups connected to the additional benzene groups.

In addition to alkyl-bridged noncondensed multiaromatic compounds and heavy monoaromatic compounds, the aromatic bottoms from an aromatic recovery complex can include condensed multiaromatic compounds. By way of example and not limitation, examples of condensed multiaromatic are shown in Formula IV, Formula V, Formula VI, and Formula VII.

[Formula IV]

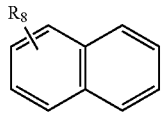

[Formula V]

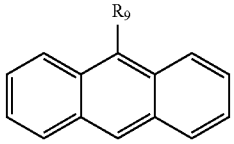

Formula VI]

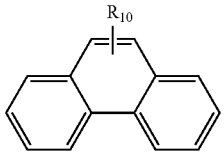

[Formula VII]

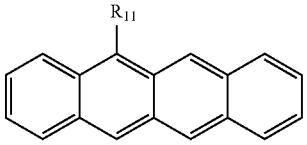

Formula IV, Formula V, Formula VI, and Formula VII show examples of condensed multiaromatics. The fused rings in the formulas are characteristic of condensed multiaromatics. $R_8$, $R_9$, $R_{10}$, and $R_{11}$ are independently selected from the group consisting of hydrogen and an alkyl group having from one to eight carbon atoms. The positions of $R_8$, $R_9$, $R_{10}$ and $R_{11}$ are exemplary only, and additional alkyl groups can bond to benzene groups in Formula IV, Formula V, Formula VI, and Formula VII in other locations.

In at least one embodiment, the aromatic bottoms can be free of sulfur, nitrogen, or both. As used in this disclosure, the terms "free" of a component, "in the absence of" a component, and "substantially free" of a component are equivalent and may include trace amounts of the component. A person of ordinary skill will understand that aromatic bottoms, or mixtures containing such aromatic bottoms, that are free of sulfur, nitrogen, or both may still contain trace amounts of sulfur, nitrogen, or both; that is, the aromatic bottoms or mixture thereof can have a concentration of sulfur that is less than about 50 ppmw, a concentration of nitrogen that is less than about 25 ppmw, or both.

Referring again to FIG. 1, aromatic polymer material can be prepared for processing. The aromatic polymer material can be prepared by comminution such as by crushing, milling, shredding, or pelletizing the aromatic polymer material. In at least one embodiment, the aromatic polymer material is a powder. In at least one embodiment, the aromatic polymer material has a particle size that is between about 0.01 centimeters (cm) and about 6 cm, such as between about 0.01 cm and about 3 cm, preferably between about 0.01 cm and about 1 cm. In at least one embodiment, the aromatic polymer material is virgin plastic (i.e., unused raw plastic material). In at least one embodiment, the aromatic polymer material is waste plastic. In FIG. 1, the aromatic polymer material is introduced to mixing unit 610 by aromatic polymer material stream 601, where it is mixed with the aromatic bottoms from aromatic bottoms stream 452. The mixing unit 610 can be any equipment suitable for mixing the aromatic polymer material and the aromatic bottoms.

It has been found that aromatic bottoms from an aromatic recovery complex can be a suitable solvent for dissolving aromatic polymer material. The mixing can be carried out continuously or in a batch process. In at least one embodiment, the mixing unit can include a continuously stirred tank. The mixing unit 610 can be operated at a temperature between about 20° C. , and 300° C., preferably between about 80° C. and 250° C. The mixing unit 610 produces a mixture having the aromatic polymer material and the aromatic bottoms. In at least one embodiment, the aromatic polymer material can be completely dissolved. In at least one embodiment, the aromatic polymer material can be suspended in a slurry having aromatic polymer material and aromatic bottoms. The aromatic bottoms is mixed with the aromatic polymer material to produce an aromatic polymer mixture, which leaves the mixing unit 610 in aromatic polymer mixture stream 611. Aromatic polymer mixture stream 611 includes the aromatic polymer material dissolved in the aromatic bottoms, suspended in the aromatic bottoms, or both. The aromatic bottoms can include alkyl-aromatic noncondensed multiaromatic compounds, condensed multiaromatics, heavy alkyl aromatics, and combinations of the same. In at least one embodiment, the aromatic polymer mixture stream 611 is saturated with aromatic polymer (i.e., the aromatic polymer mixture stream 611 contains the maximum equilibrium amount of the aromatic polymer at the mixing temperature). In at least one embodiment, the amount of aromatic polymer that is mixed with the aromatic bottoms can be up to 20 wt %. The aromatic polymer mixture stream 611 is then sent to coking unit 600.

In at least one embodiment, the aromatic polymer mixture stream 611 can be preheated before being introduced to coking unit 600. The coking unit 600 includes a fluidized reactor configured to catalytically crack the aromatic polymer mixture stream 611.

Figure 5:
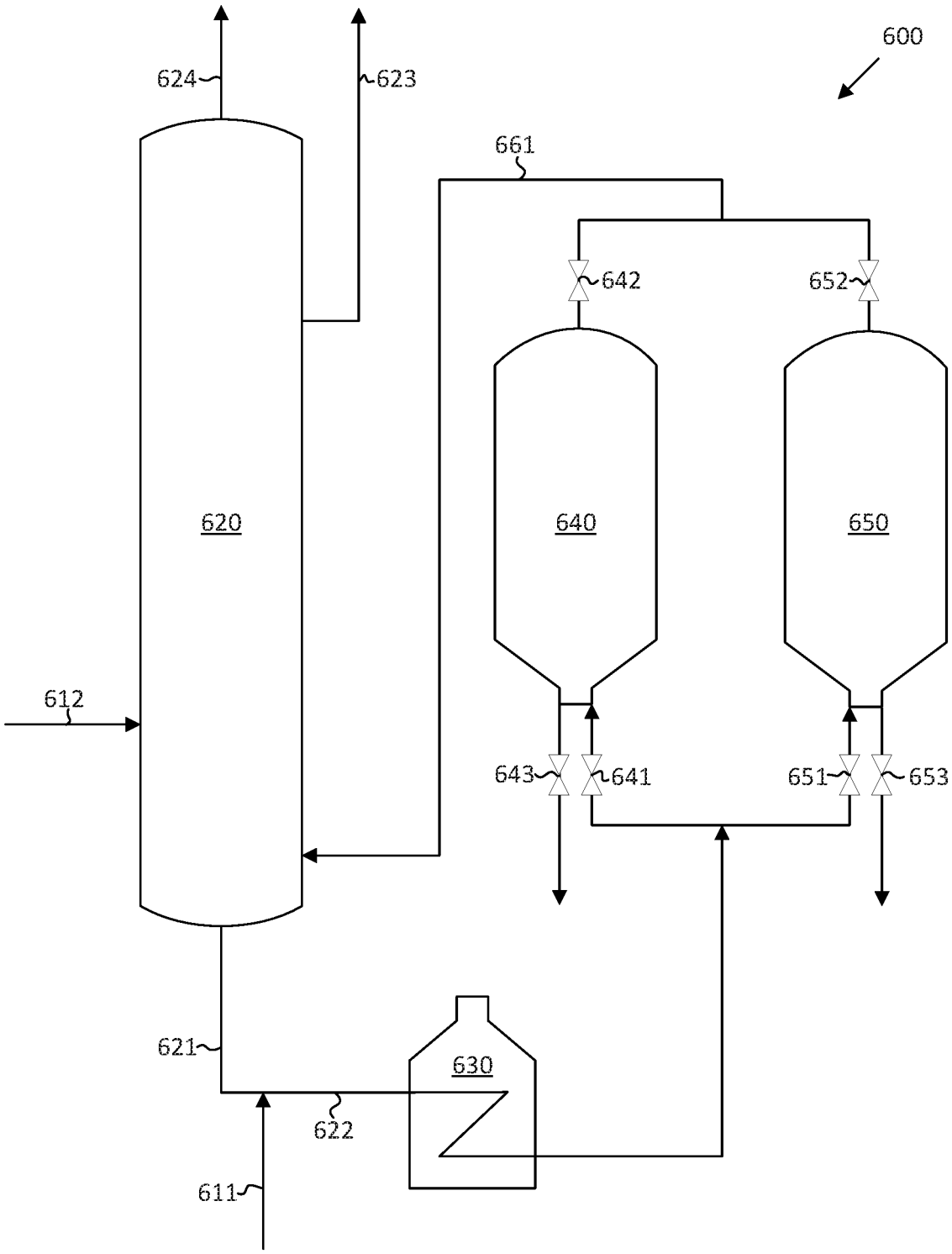
FIG. 5 is a schematic illustration of a delayed coking process configured to process an aromatic polymer mixture.

By way of example and not limitation, FIG. 5 shows an example of a coking unit configured to process aromatic polymer mixture stream 611 to produce needle coke and aromatic products. A coking unit is an oil refinery processing unit for converting low-value residual oil, or residue, from the vacuum or atmospheric distillation of a hydrocarbon feed into products such as lower molecular weight hydrocarbon gases, naphtha, light and heavy gas oils, and petroleum green coke. Coking involves thermally cracking long-chain hydrocarbon molecules in the residue into shorter-chain molecules. Coking is preferred for vacuum residues that contain significant amounts of metals because the metals ultimately reside in solid coke, which is readily and economically disposed. Advantageously, liquid products from coking can be substantially free of metals.

A typical coking process includes fractionating a feedstock in a fractionator to obtain gas products, liquid products, and bottoms. The bottoms are sent to a furnace where they are heated to a coking temperature. After heating, the bottoms are sent to a coke drum which is operated under coking conditions. The bottoms are thermally cracked in the coke drum to obtain volatile components and polynuclear aromatic compounds commonly referred to as "coke." The process where heating to a cracking temperature is carried out before introducing the feed to a coke drum under coking conditions is referred to as a delayed coker process. Volatile components recovered from the coke drum as vapor are returned to the fractionator. Coke deposited in the coke drum accumulates as coking is carried out. After the coke drum fills to a predetermined stopping point, the feed to the coke drum can be stopped or sent to another coke drum. The coke drum is then cooled and emptied. After emptying, feed is again sent to the coke drum.

The volatile components from the coking process can include gas products such as C1-c4 hydrocarbons, and liquid products including hydrocarbons boiling above about 36° C. Raw coke produced in a delayed coking process is referred to as petroleum green coke. Petroleum green coke can be converted by calcination to fuel-grade coke, anode-grade coke, needle coke, or a combination of these. The concentration of contaminants in the feed to the coking process determines the quality of the petroleum green coke, and consequently the grade of coke produced. Feeds having significant amounts of asphaltenes, metal, and sulfur content produce fuel-grade coke. Feeds having fewer contaminants yield higher grade coke, such as anode-grade coke or needle-grade coke. Needle coke, which contains the least amount of contaminants (such as sulfur, nitrogen, and metals), and is considered a high-quality coke having significant economic value related to its various commercial uses. Advantageously, aromatic polymer material dissolved in aromatic bottoms can be substantially free of contaminants such as sulfur, nitrogen, and metals; making the aromatic polymer mixture stream 611 a suitable feedstock for producing needle-grade coke. Moreover, aromatic products such as benzene, toluene, xylenes, and combinations of the same can be recovered from relatively low-value aromatic bottoms in the process. Properties of these three grades of coke (fuel-grade, anode-grade, and needle-grade coke) are tabulated in Table 1.

TABLE 1

Properties of fuel-grade coke, anode-grade coke, and needle-grade coke.

| Properties | Fuel-grade coke | Anode-grade coke | Needle-grade coke |
|---|---|---|---|
| Bulk density, kg/m$^3$ | 880 | 720-800 | 670-720 |
| Max sulfur, wt % | 3.5-7.5 | 1.0-3.5 | 0.2-0.5 |
| Max nitrogen, ppmw | 6,000 | — | 50 |
| Max nickel, ppmw | 500 | 200 | 7 |
| Vanadium, ppmw | 150 | 350 | — |
| Max volatile combustible material, wt % | 12 | 0.5 | 0.5 |
| Max ash content, wt % | 0.35 | 0.4 | 0.1 |
| Max moisture content, wt % | 8-12 | 0.3 | 0.1 |
| Hardgrove grindability index, wt % | 35-70 | 60-100 | — |

Referring to FIG. 5, distillation column feed 612 is introduced to distillation column 620 where the distillation column feed 612 is fractionated to obtain a residue stream 621, a gas product stream 624, and a liquid product stream 623. The distillation column 620 can be a vacuum distillation column or an atmospheric distillation column. The residue stream 621 is combined with the aromatic polymer mixture stream 611 to produce coker feed stream 622, which is sent to furnace 630 where it is heated to a coking temperature between about 450° C. and about 600° C., preferably between about 490° C. and about 550° C. After heating in furnace 630, coker feed stream 622 is sent to a first coke drum 640 which is operated under coking conditions. In at least one embodiment, coking is carried out at a pressure between about 1 bar and about 3 bar for a period of time that is between about 6 hours and about 12 hours. Thermal cracking of coker feed stream 622 is carried out in the first coke drum 640 to obtain volatile components and petroleum green coke until a predetermined stop point (such as filling to a certain point) is reached; at which point the flow of coker feed stream 622 is switched to second coke drum 650 by closing first inlet valve 641 and first volatile component outlet valve 642 and opening second inlet valve 651 and second volatile component outlet valve 652. In at least one embodiment, coking can be carried out in the presence of a homogenous catalyst. In at least one embodiment, the homogenous catalyst includes an element selected from IUPAC groups 4-7. Nonlimiting examples of suitable homogenous catalysts include molybdenum acetylacetonate, molybdenum hexacarbonyl, etc. First coke drum 640 is then cooled. After cooling, first coke outlet valve 643 is opened and first coke drum 640 is emptied using methods known to a person of ordinary skill.

Meanwhile, coking is carried out in second coke drum 650 until a predetermined stop point is reached; at which point, if the first coke drum 640 is empty, the flow of coker feed stream 622 can be switched to the first coke drum 640 by closing second inlet valve 651 and second volatile component outlet valve 652 and opening first inlet valve 641 and first volatile component outlet valve 642. First coke drum 640 is returned to coking operating conditions and coking of coker feed stream 622 is carried out in first coke drum 640. As coking resumes in first coke drum 640, second coke outlet valve 653 is opened and second coke drum 650 is emptied in the same manner previously described. The petroleum green coke emptied from first and second coke drums 640, 650 can be calcined using conventional calcining techniques to produce needle-grade coke.

Volatile components produced during coking leave the first and second coke drums 640 and 650 in volatile component stream 661, which is sent to distillation column 620 to obtain distillate products such as gas products which leave in a gas product stream 624 and a liquid products which leave in liquid product stream 623. In at least one embodiment, the liquid product stream 623 can include benzene, toluene, xylene, and combinations of the same.

Figure 2:
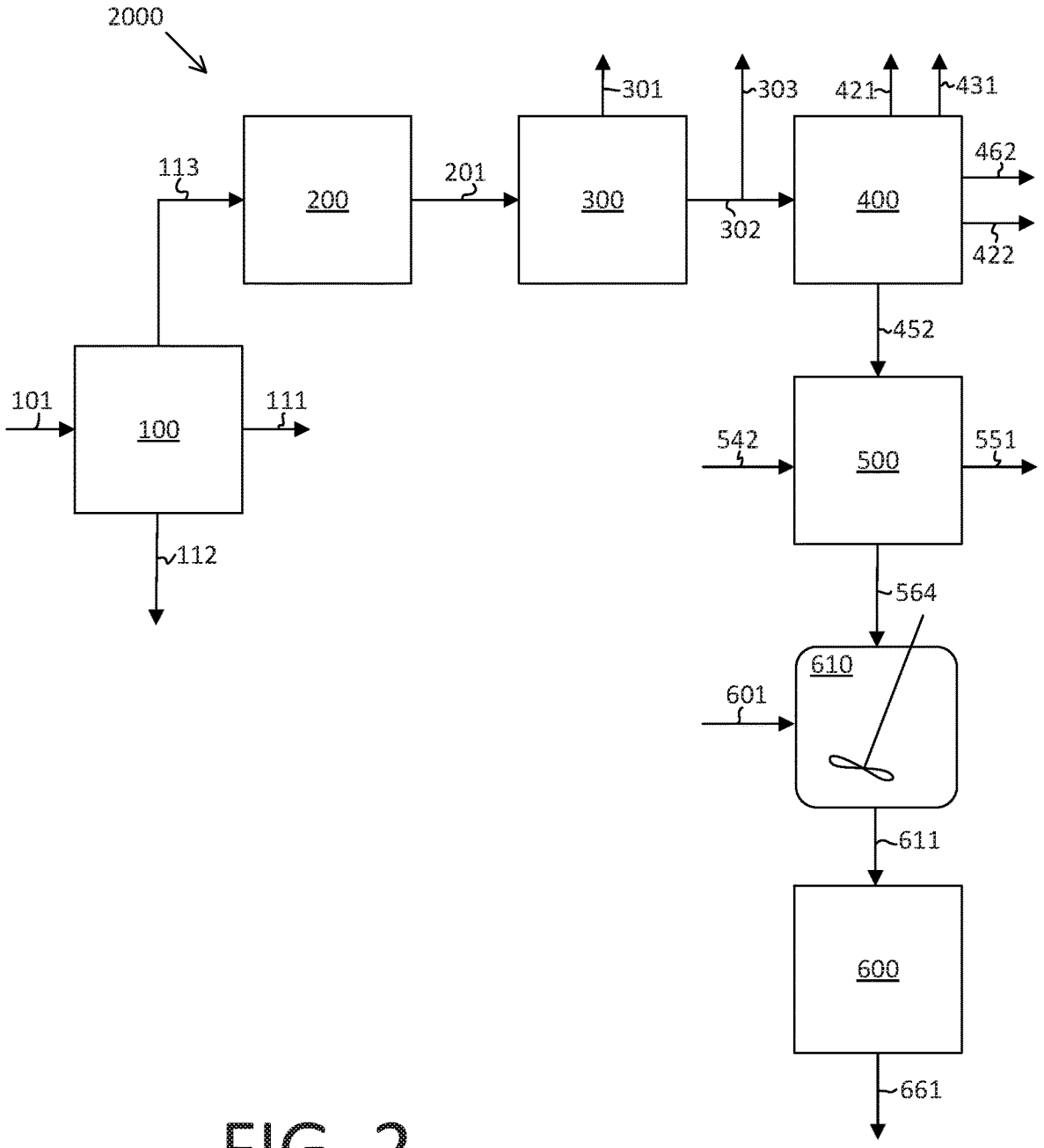
FIG. 2 is a schematic diagram of a process for producing needle-grade coke from an aromatic polymer mixture according to various embodiments.

A schematic diagram of various embodiments of a process for converting an aromatic polymer to needle-grade coke and recovering aromatic products is shown in FIG. 2. In FIG. 2, crude oil is processed similar to the process shown and described in FIG. 1 and FIG. 3, except that aromatic bottoms stream 452 is sent to hydrodearylation unit 500 to produce hydrodearylated bottoms, which leave the hydrodearylation unit 500 in hydrodearylated aromatic bottoms stream 564. The hydrodearylated aromatic bottoms stream 564 is mixed with the aromatic polymer material stream 601 to dissolve or suspend the aromatic polymer material and produce aromatic polymer mixture stream 611. The aromatic polymer mixture stream 611 is then sent to coking unit 600, where it is cracked in the presence of a catalyst similar to the processes shown and described in FIG. 1, FIG. 5, and FIG. 6.

Figure 4:
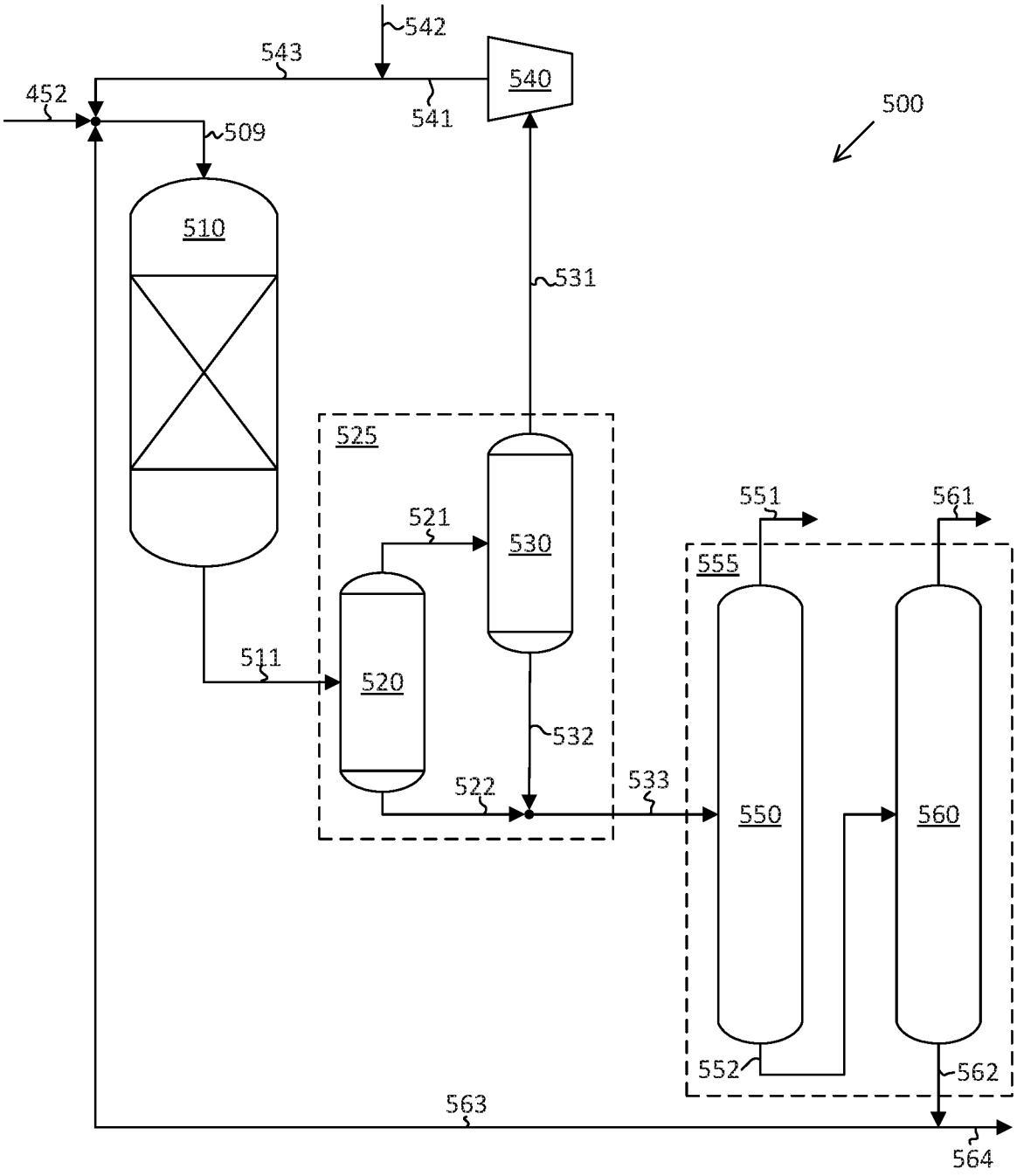
FIG. 4 is a schematic illustration of a hydrodearylation unit and process for hydrodearylating aromatic bottoms from an aromatic recovery complex.

In FIG. 4, a schematic diagram of a process for hydrodearylating the aromatic bottoms is shown. The hydrodearylation unit 500 can include a hydrodearylation reactor 510. The hydrodearylation reactor 510 can include an effective quantity of a suitable catalyst. The catalyst can be in a catalyst bed. The hydrodearylation reactor 510 can include an inlet for receiving a combined feed stream 509 including aromatic bottoms stream 452, a recycled bottoms stream 563, and a combined hydrogen stream 543. In at least one embodiment, the aromatic bottoms stream 452 can include C9+ aromatic hydrocarbons in the absence of C8− components. In at least one embodiment, the aromatic bottoms stream 452 can include C10+ aromatic hydrocarbons in the absence of C9− components. In at least one embodiment, the aromatic bottoms stream 452 can include C11+ aromatic hydrocarbons in the absence of C10− components. A hydrodearylated effluent stream 511 can be discharged from an outlet of hydrodearylation reactor 510. The hydrodearylation reactor 510 can have a single or multiple catalyst beds and can receive quench hydrogen stream in between the beds of a multibed arrangement. Although not shown, the quench hydrogen stream can be a portion of the combined hydrogen stream 543 piped to the various locations of the catalyst beds in the hydrodearylation reactor 510.

In at least one embodiment, the degree of conversion in the hydrodearylation reactor 510 can be kept below a threshold to limit the amount of catalyst required and the amount of coking on the catalyst. By way of example and not limitation, a threshold limit can be 75% of a maximum potential conversion in the hydrodearylation reactor 510. The hydrodearylated effluent stream 511 can pass to a separation zone 525. The separation zone can include two separators, a hot separator 520 and a cold separator 530. The hot separator 520 can include an inlet for receiving the hydrodearylated effluent stream 511, an outlet for discharging a hydrodearylated gas stream 521, and an outlet for discharging a hot hydrodearylated liquid stream 522. The cold separator 530 can include an inlet for partially condensed hydrodearylated gas stream 521, an outlet for discharging a vapor recycle stream 531 and outlet for discharging a hydrocarbon liquid stream 532. Heat exchangers can be included to cool the hydrodearylated gas stream 521 before entering subsequent cold separator 530. The heat exchangers are not shown and any design requirements for the heat exchangers are well understood by a person having ordinary skill in the art. The hydrodearylated gas stream 521 can include one or more gases selected from a group consisting of hydrogen, methane, ethane, C3+ hydrocarbons, and combinations thereof. The hydrodearylated gas stream 521 can exit the hot separator 520 and be fed to the cold separator 530.

The vapor recycle stream 531 from cold separator 530 can be rich in hydrogen. The vapor recycle stream 531 can be recycled to the hydrodearylation reactor 510 after compression with a compressor 540 to produce a compressed recycle stream 541. The compressed recycle stream 541 can be combined with a hydrogen make-up stream 542. The hydrogen make-up stream 542 can be a high purity make-up gas substantially containing hydrogen from a header. The combined hydrogen stream 543 can be recycled back to the feed section through the header to provide hydrogen to the hydrodearylation reactor 510.

The hydrocarbon liquid stream 532 from the cold separator 530 can be preheated in a heat exchanger train (not shown). The hydrocarbon liquid stream 532 can be combined with the hot hydrodearylated liquid stream 522 to form a separator liquid effluent stream 533, which can flow to a fractionation zone 555.

The fractionation zone 555 can include a stripper column 550 and a splitter column 560. The stripper column 550 and splitter column 560 can be reboiled fractionation columns. The separator liquid effluent stream 533 can enter the stripper column 550. The stripper column 550 can be a trayed column or a packed column, or a combination of the two types of columns. The stripper column 550 can separate the separator liquid effluent stream 533 into two streams, a light vapor stream 551 and a bottom stream 552. The light vapor stream 551 can be condensed, and a portion can be used as a liquid reflux for the stripper column 550. A portion of the condensed and non-condensed light vapor stream 551 can be routed for further processing. By way of example and not limitation, the condensed and non-condensed light vapor stream 551 can be processed in a reformate splitter column or a heavy aromatics column within a para-xylene aromatic recovery complex. These details of further processing are not shown in FIG. 2 as they are understood by a person of ordinary skill in the art.

The bottom stream 552 from stripper column 550 can be routed to the splitter column 560. The splitter column 560 can be a trayed column or a packed column, or a combination of the two types of columns. The splitter column 560 can form two streams, a light stream 561 and a heavy stream 562. The light stream 561 can include C6+ compounds. In at least one embodiment, the heavy stream 562 can include C10+ compounds in the absence of C9− compounds. In at least one embodiment, the heavy stream 562 can include C11+ compounds in the absence of C10− compounds.

The light stream 561 can be condensed and portion of the condensed light stream can be used as a liquid refluxed to the splitter column 560. A portion of the light stream 561 that is not refluxed to the splitter column 560 can be routed for further processing. By way of example, this portion of the light stream 561 can be routed to a reforming/para-xylene complex for xylene recovery. The heavy stream 562 can be split into two streams, a recycled bottoms stream 563 and a hydrodearylated aromatic bottoms stream 564 having hydrodearylated aromatic bottoms. The hydrodearylated aromatic bottoms stream 564 can then be sent to mixing unit 610 of FIG. 2. In at least one embodiment, the hydrodearylated aromatic bottoms stream 564 can include compounds boiling at temperatures of at least about 180° C. in the absence of compounds boiling at temperatures below about 180° C. In at least one embodiment, the hydrodearylated aromatic bottoms stream 564 can include C11+ compounds in the absence of C10− compounds.

In at least one embodiment, the combined hydrogen stream 543 can be a once-through stream without recycling via vapor recycle stream 531 and compressed recycle stream 541. Accordingly, a hydrogen make-up stream 542 can be added via a manifold to form combined hydrogen stream 543 without compressed recycle stream 541. In at least one embodiment, flashed gases from the cold separator 530 can be routed out of hydrodearylation unit 500 and back to a hydrogen generation source (not shown). In at least one embodiment, when the combined hydrogen stream 543 is a once-through stream, the separator liquid effluent stream 533 can be directly routed to a xylene rerun column within a para-xylene complex.

In at least one embodiment, the hot and cold separators 520, 530 can be replaced by a single separator with a heat exchanger train to preheat the combined hydrogen stream 543 or the combined feed stream 509 with hydrodearylated effluent stream 511.

In at least one embodiment, the aromatic bottoms stream 452 can include C9+, C10+, or C11+ hydrocarbons from an aromatic bottoms stream of an aromatic recovery complex such as the aromatic recovery complex of FIG. 3. The aromatic bottoms stream 452 can include C9–C16+ hydrocarbons, and this stream can be predominantly mono-aromatics, di-aromatics, and poly-aromatics. The aromatic bottoms stream 452 can include alkyl-bridged noncondensed multiaromatics, condensed multiaromatics, heavy monoaromatics, and combinations of the same.

In at least one embodiment, the hydrodearylation reactor 510 can have a single catalyst bed or multiple catalyst beds. In at least one embodiment, the multiple catalyst beds can receive a quench hydrogen stream between the beds. Although not illustrated in FIG. 4, the combined hydrogen stream 543 can be provided anywhere along the hydrodearylation reactor 510, and multiple hydrogen streams can be provided, depending upon the number of beds.

In at least one embodiment, the hydrodearylation reactor 510 can contain a catalyst having at least one International Union of Pure and Applied Chemistry (IUPAC) Group 8-10 metal, and at least one IUPAC Group 6 metal. The IUPAC Group 8-10 metal can be selected from the group consisting of iron, cobalt, and nickel, and combinations of the same. The IUPAC Group 6 metal can be selected from a group consisting of molybdenum and tungsten, and combinations thereof. The IUPAC Group 8-10 metal can be present in an amount of approximately 2-20 percent by weight (wt %), and the IUPAC Group 6 metal can be present in an amount of approximately 1-25 wt %. In at least one embodiment, the IUPAC Group 8-10 and IUPAC Group 6 metals can be on a support material. In at least one embodiment, the support material can be silica or alumina, and can further include an acidic component selected from the group consisting of an amorphous silica alumina, a zeolite or a combination of the two. In various embodiments, the hydrodearylation reactor 510 can contain a catalyst having any noble IUPAC Group 8-10 metal on a silica-alumina or alumina support having an acid cracking component of an amorphous silica-alumina or a zeolite, or a combination of the two. In certain embodiments, the hydrodearylation reactor 510 can contain a catalyst selected from the group consisting of platinum, palladium, and combinations thereof, on a silica-alumina or alumina support having an acid cracking component of an amorphous silica- alumina or a zeolite, or a combination of the two.

In at least one embodiment, operating conditions for the hydrodearylation reactor 510 can include a reaction temperature in the range of from about 200° C. to about 450° C. (392° F. to 840° F.), and a hydrogen partial pressure in the range of from about 5 bar gauge to about 80 bar gauge (70 psig to 1160 psig). In at least one embodiment, operating conditions for the hot separator 520 can include a temperature in the range of from about 200° C. to about 400° C. (392° F. to 752° F.), and a hydrogen partial pressure in the range of from 5 bar gauge to 80 bar gauge (70 psig to 1160 psig). In at least one embodiment, operating conditions for the cold separator 530 can include a temperature in the range of from 40° C. to 80° C. (104° F. to 176° F.), and a pressure in the range of from 5 bar gauge to 80 bar gauge (70 psig to 1160 psig). In at least one embodiment, operating conditions for the fractionation zone 555 can include a temperature in the range of from 40° C. to 300° C. (104° F. to 572° F.), and a pressure in the range of from 0.05 bar to 30 bar (0.73 psig to 435 psig).

EXAMPLES

The following examples are included to demonstrate embodiments of the disclosure, and should be considered nonlimiting. The techniques and compositions disclosed in the examples which follow represent techniques and compositions discovered to function well in the practice of the disclosure, and thus can be considered to constitute modes for its practice. However, changes can be made to the embodiments disclosed in the examples without departing from the spirit and scope of the disclosure.

Example 1—Dissolution of Polystyrene with Aromatic Bottoms Bolvent

A 7.5 (g) sample of polystyrene having an average particle size of about 1-2 cm was fully dissolved in about 50 g of liquid aromatic bottoms from an aromatic recovery complex. The aromatic bottoms consisted of C11+ hydrocarbons. The mixing was carried out at a temperature of about 20° C. and under atmospheric pressure. Properties of the aromatic bottoms and the mixture of dissolved polystyrene in aromatic bottoms are tabulated in Table 2.

TABLE 2

Properties of aromatic bottoms from an aromatic recovery complex, and a mixture of dissolved polystyrene with aromatic bottoms.

| Properties | Aromatic bottoms | Mixture of aromatic bottoms and polystyrene |
|---|---|---|
| Specific gravity, g/cm$^3$ | 0.9964 | 0.9907 |
| API gravity, degrees | 2.12 | 8.77 |
| Sulfur, ppmw | 330 | 286 |
| Nitrogen, ppmw | 6 | 5.27 |
| Carbon residue, wt % | 0.14 | 0.23 |
| Viscosity, cSt | | |
| 25° C. | 4.3 | — |
| 40° C. | 2.9 | 91.3 |
| 50° C. | — | 71.8 |
| 100° C. | — | 10.9 |
| Gross heat value, BTU/lb | — | 18,031 |
| Simulated distillation, ° C. | | |
| 0 wt % | 198 | 192 |
| 5 wt % | 201 | 199 |
| 10 wt % | 204 | 206 |
| 30 wt % | 226 | 242 |
| 50 wt % | 258 | 272 |
| 70 wt % | 292 | 297 |
| 90 wt % | 332 | 324 |
| 95 wt % | 362 | 351 |
| 100 wt % | 468 | 476 |

Example 2-Delayed Coking of Polystyrene Dissolved in Aromatic Bottoms

About 25 grams of a mixture of polystyrene foam and aromatic bottoms (having the same properties as the aromatic bottoms in Table 2) was prepared with a weight ratio of 1:9 polystyrene to aromatic bottoms. The reactor was set to heat the mixture to 475° C. under 50 bar pressure. Reaction time was measured once the temperature reached 400° C., and the experiment continued for 5.3 hours. The average temperature and pressure of the unit were 467° C. and 42.2 bar respectively. After the reaction was carried out, the reactor was cooled in air to 40° C. and then in an ice bath to 15° C. The initial heating period was one hour. The system was depressurized, releasing the gases produced during the reaction, and the liquid and solid products of the reaction were separated by decanting and filtering using a sintered glass filter. The solid coke produced was washed with pentane to remove any residual oil. The yield of the reaction is tabulated in Table 3A, and the properties of the liquid obtained from coking are tabulated along with properties of the mixture of polystyrene dissolved in aromatic bottoms in Table 3B.

TABLE 3A

Yield from delayed coking of a mixture of polystyrene dissolved in aromatic bottoms with a weight ratio of 1:9 polystyrene to aromatic bottoms.

| Phase | Yield, wt % |
|---|---|
| Coke | 24.7 |
| Liquid | 45.4 |
| Gases | 29.9 |

TABLE 3B

Properties of polystyrene dissolved in aromatic bottoms and liquid product from delayed coking of polystyrene dissolved in aromatic bottoms.

| Properties | Mixture of polystyrene dissolved in aromatic bottoms | Liquid product from delayed coking of mixture of polystyrene dissolved in aromatic bottoms |
|---|---|---|
| Specific gravity, g/cm$^3$ | 0.9907 | 0.9964 |
| API, degrees | 8.77 | 9.52 |
| Carbon residue, wt % | 0.23 | — |
| Viscosity | | |
| 40° C., cSt | 91.3 | — |
| 50° C., cSt | 71.8 | — |
| 100° C., cSt | 10.9 | — |
| Gross heat value, BTU/lb | 18,031 | — |
| Simulated distillation, ° C. | | |
| 0 wt % | 192 | 80 |
| 5 wt % | 199 | 112 |
| 10 wt % | 206 | 137 |
| 30 wt % | 242 | 207 |
| 50 wt % | 272 | 226 |
| 70 wt % | 297 | 251 |
| 90 wt % | 324 | 302 |
| 95 wt % | 351 | 330 |
| 100 wt % | 476 | 433 |

The liquid products consisted of 11.3 wt % naphtha containing BTX, 19.6 wt % kerosene, 14.3 wt % diesel, 0.4 wt % heavy oil boiling above 375° C. Because the mixture of polystyrene dissolved in aromatic bottoms was substantially free of contaminants, aromatic products such as BTX can be recovered in an aromatic recovery complex and the fuels can be blended in a clean fuels pool.

We claim:

1. A method for converting an aromatic polymer material and an aromatic bottoms to needle-grade coke, the method comprising:

supplying the aromatic bottoms from an aromatic recovery complex;

mixing the aromatic polymer material with the aromatic bottoms to obtain an aromatic polymer mixture comprising the aromatic polymer material and the aromatic bottoms;

delayed coking the aromatic polymer mixture to obtain petroleum green coke and volatile components;

fractionating the volatile components to obtain distillate products; and calcining the petroleum green coke to obtain needle coke.

2. The method of claim 1, wherein the aromatic polymer material comprises polystyrene.

3. The method of claim 1, wherein the aromatic bottoms is free of sulfur.

4. The method of claim 1, wherein the aromatic bottoms is free of nitrogen.

5. The method of claim 1, wherein the aromatic bottoms comprises C9+hydrocarbons.

6. The method of claim 1, wherein the aromatic bottoms comprises a compound selected from the group consisting of alkyl-bridged noncondensed multiaromatic compounds, condensed multiaromatic compounds, heavy monoaromatic compounds, and combinations of the same.

7. The method of claim 1, wherein the aromatic bottoms has a boiling point of at least 100° C.

8. The method of claim 1, wherein the aromatic bottoms comprises up to 20 wt % aromatic polymer material.

9. The method of claim 1, wherein the aromatic polymer material comprises a waste plastic.

10. The method of claim 1, wherein the step of delayed coking the aromatic polymer mixture includes delayed coking the aromatic polymer mixture with a homogengous catalyst.

11. The method of claim 10, wherein the homogengous catalyst comprises an element selected from the group consisting of IUPAC groups 4-7, and combinations of the same.

12. The method of claim 11, wherein the homogengous catalyst is selected from the group consisting of molybdenum acetylacetonate, molybdenum hexacarbonyl, and combinations of the same.

13. A method for converting an aromatic polymer material and an aromatic bottoms to needle-grade coke, the method comprising:

supplying the aromatic bottoms from an aromatic recovery complex, and hydrodearylating the aromatic bottoms to obtain hydrodearylated aromatic bottoms;

mixing the aromatic polymer material with the hydrodearylated aromatic bottoms to obtain an aromatic polymer mixture comprising the aromatic polymer material and the hydrodearylated aromatic bottoms;

delayed coking the aromatic polymer mixture to obtain petroleum green coke and volatile components;

fractionating the volatile components to obtain distillate products; and calcining the petroleum green coke to obtain needle coke.

14. The method of claim 13, wherein the aromatic polymer material comprises polystyrene.

15. The method of claim 13, wherein the aromatic bottoms is free of sulfur.

16. The method of claim 13, wherein the aromatic bottoms is free of nitrogen.

17. The method of claim 13, wherein the aromatic bottoms comprises C9+ hydrocarbons.

18. The method of claim 13, wherein the aromatic bottoms comprises a compound selected from the group consisting of alkyl-bridged noncondensed multiaromatic compounds, condensed multiaromatic compounds, heavy monoaromatic compounds, and combinations of the same.

19. The method of claim 13, wherein the aromatic bottoms has a boiling point of at least 100° C.

20. The method of claim 13, wherein the aromatic polymer mixture comprises up to 20 wt % aromatic polymer material.

21. The method of claim 13, wherein the aromatic polymer material comprises a waste plastic.

22. The method of claim 13, wherein the step of delayed coking the aromatic polymer mixture includes delayed coking the aromatic polymer mixture with a homogengous catalyst.

23. The method of claim 22, wherein the homogengous catalyst comprises an element selected from the group consisting of IUPAC groups 4-7, and combinations of the same.

24. The method of claim 23, wherein the homogengous catalyst is selected from the group consisting of molybdenum acetylacetonate, molybdenum hexacarbonyl, and combinations of the same.

* * * * *